United States Patent [19]

Marshall, Jr.

[11] 4,074,872

[45] Feb. 21, 1978

[54] EMERGENCY BATHROOM TISSUE HOLDER

[76] Inventor: Robert Marshall, Jr., 731 S. Cascade Drive, Woodburn, Oreg. 97071

[21] Appl. No.: 752,208

[22] Filed: Dec. 20, 1976

[51] Int. Cl.[2] ..... B65H 19/00

[52] U.S. Cl. ..... 242/55.54

[58] Field of Search ..... 242/55.2, 55.3, 55.42, 242/55.54; 211/16, 86; 225/46, 76; 248/227, 339, 304; 116/114 R; 250/462, 463

[56] References Cited

U.S. PATENT DOCUMENTS

| | | | |
|---|---|---|---|
| 1,888,426 | 11/1932 | Duby | 242/55.2 |
| 2,244,804 | 6/1941 | Robinson | 242/55.2 |
| 2,570,491 | 10/1951 | Scardina | 242/55.54 |
| 2,761,069 | 8/1956 | Brayer | 250/462 |
| 3,017,051 | 1/1962 | Rosenfeld | 250/462 |

*Primary Examiner*—Leonard D. Christian
*Attorney, Agent, or Firm*—Lee R. Schermerhorn

[57] ABSTRACT

An L-shaped bracket has a hook on its upper end for hanging the bracket on the upper edge of the wall of a toilet tank. An upstanding pin on the lower end of the bracket holds a spare roll of bathroom tissue. The pin is colored a brilliant fluorescent red so as to be conspicuous when there is no roll of paper on the pin.

6 Claims, 4 Drawing Figures

30
25
22
20
15
21
23
12
13
11
10
26
25
20A
34
35
32
34
36
33

26
30
25
15
21
13
22
23
24
20
12

15
23
26
24
21

EMERGENCY BATHROOM TISSUE HOLDER

BACKGROUND OF THE INVENTION

This invention relates to an energency bathroom tissue holder to provide a spare roll of paper after the usual supply is exhausted.

Bathroom tissue holders have heretofore been made to contain two rolls of paper with the intention that the rolls be used one at a time so that there will always be at least one roll available. It usually happens, however, that both rolls are used simultaneously with the result that there are times when there is no paper in the bathroom.

This experience is particularly annoying in hotels and motels where first class service is expected. In such living quarters a spare roll may be provided but it is often sequestered in some closet or dresser drawer elsewhere on the premises rather than in the bathroom. The guest does not always have the foresight to anticipate his needs and locate the reserve paper supply beforehand.

Objects of the invention are, therefore, to provide a spare bathroom tissue holder in the bathroom, to provide an emergency paper supply which is not likely to be used concurrently with the main supply, and to provide a holder which may be attached to a toilet water tank in an easily removable manner.

SUMMARY OF THE INVENTION

The present holder comprises an L-shaped bracket having a hook for hanging the bracket on the upper edge of the wall of the toilet tank. An upstanding pin on the bracket holds a spare roll of bathroom tissue which is readily available but not as convenient as the usual supply whereby the emergency roll will not be used concurrently with the roll that is intended to be used. The pin is colored a brilliant fluorescent red so as to be conspicuous to the maid when there is no roll of paper on the pin.

The invention will be better understood and the foregoing and additional objects and advantages will become apparent from the following description of the preferred embodiment of the invention illustrated on the accompanying drawing. Various changes may be made, however, in the details of construction and arrangement of parts and certain features may be used without others. All such modifications within the scope of the appended claims are included in the invention.

DESCRIPTION OF THE PREFERRED EMBODIMENTS

Figures 1, 2, 3, 4:
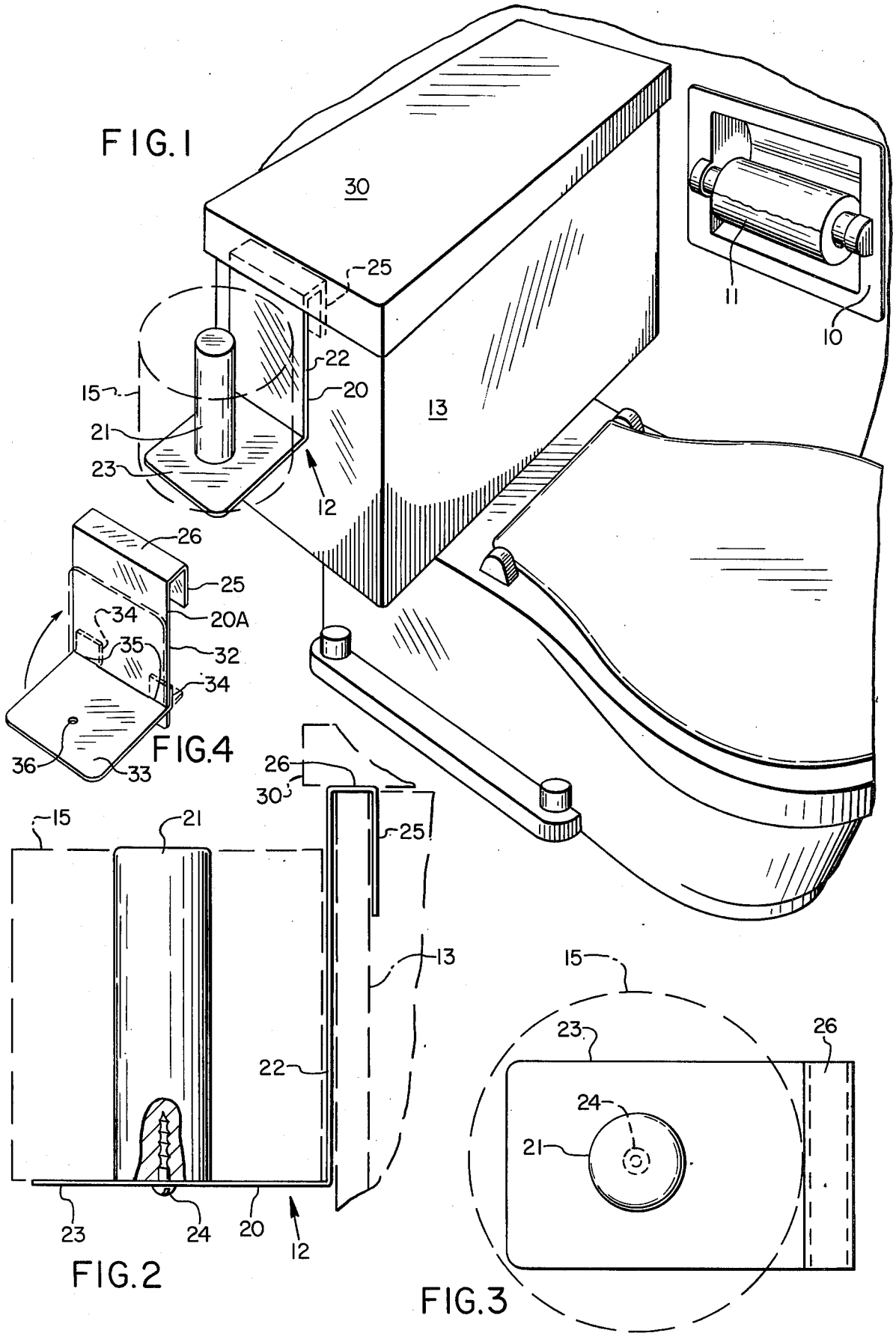
FIG. 1 is a perspective view of a typical bathroom installation embodying the invention.
FIG. 2 is side elevation view of the holder in FIG. 1 with parts broken away.
FIG. 3 is a top plan view.
FIG. 4 is a perspective view of a modification.

In FIG. 1 a conventional holder 10 is mounted in the bathroom wall to support a roll of paper 11 in a convenient position. The present holder 12 is mounted on one end of the toilet water tank 13 to hold emergency roll of paper 15 in a position where it is visible and readily available but less convenient than the roll 11. Thus, the spare roll 15 is not likely to be used concurrently with the roll 11.

Holder 12 comprises essentially a bracket 20 and pin 21. Bracket 20 preferably is formed of a flat strip of metal or plastic bent to L-shape as shown. The strip forming the bracket 20 has a vertical leg 22 with a horizontal leg 23 outstanding from one face of the vertical leg at the lower end thereof. Vertical pin 21 is preferably made of wood and mounted on leg 23 by a screw 24.

Bracket 20 has a hook 25 on its upper end. Hook 25 preferably comprises a U-shaped bend 26 in the strip of material forming bracket 20 which is outstanding from the opposite face of vertical leg 22, in relation to the horizontal leg 23. The hook 25 may be engaged over the upper edge of the wall of toilet tank 13 and held securely in place by the tank cover 30.

In order to alert the maid, in the course of her duties, as well as the occupants, when the spare roll of paper 15 is not in place on the holder 12, the pin 21 is painted a brilliant flourescent red so as to be very conspicuous when the pin is exposed to view. Even if the brilliant color fails to arouse the maid to take remedial action, the occupants, at least, will be alerted to the absence of the spare roll 15. Normally, the cylindrical surface of pin 21 is concealed by the roll 15.

FIG. 4 illustrates a modification made in two parts to fold together for shipping. In this embodiment the bracket 20A has a vertical leg 32 and a separate horizontal leg 33. The later has a pair of right angle tongues 34 adapted to pivot in slots 35 in leg 32. Horizontal leg 33 has a screw hole 36 to receive a screw 24 for mounting the pin 21 as in FIG. 2.

The holder in FIG. 4 is shipped without screw 24 and pin 21 installed on leg 33, these parts being included in the package for assembly by the purchaser. In this condition horizontal leg 33 may be folded up against vertical leg 32 as shown in broken lines to make a more campact package. When leg 33 is pivoted down to horizontal position the tongues 34 bear against the back side of vertical leg 32 to limit the pivotal movement.

What is claimed is:

1. An emergency bathroom tissue holder comprising an L-shaped bracket having a vertical leg with transverse slots and a horizontal leg outstanding from the lower end of said vertical leg, a vertical upstanding pin on said horizontal leg for holding a roll of paper on said horizontal leg, a hook on the upper end of said vertical leg for hanging the holder on the upper edge of the wall of a toilet tank, and a hinge connecting said horizontal leg to said vertical leg, said hinge comprising a pair of right angle tongues on said horizontal leg having pivotal movement in said slots in said vertical leg.

2. A holder as defined in claim 1, said bracket being formed from to two flat strips of material with said horizontal legs outstanding from one face of said vertical leg and said hook outstanding from the opposite face of said vertical leg.

3. A holder as defined in claim 2, said hook comprising a U-shaped bend in the upper end of said strip of material.

4. A holder as defined in claim 3, said pin including means exhibiting a striking appearance so as to be conspicuous and attract attention when there is no roll of paper on the pin.

5. A holder as defined in claim 4, said means comprising a distinctive coloration such as brilliant fluorescent red.

6. A holder as defined in claim 1, said tongues bearing against the back side of said vertical leg to limit said pivotal movement in operative position.

* * * * *